United States Patent [19]

Salek

[11] Patent Number: 4,638,504

[45] Date of Patent: Jan. 20, 1987

[54] INDEPENDENT CHANNEL MODULATION SYSTEM FOR AM STEREO

[75] Inventor: Stanley Salek, Mesa, Ariz.

[73] Assignee: Broadcast Electronics, Inc., Quincy, Ill.

[21] Appl. No.: 749,814

[22] Filed: Jun. 28, 1985

[51] Int. Cl.[4] ..... H04H 5/00

[52] U.S. Cl. ..... 381/16; 332/23 A; 332/21

[58] Field of Search ..... 332/17, 18, 21, 22, 332/23 A; 381/2, 3, 4, 15, 16

[56] References Cited

U.S. PATENT DOCUMENTS

| | | | |
|---|---|---|---|
| 3,732,375 | 5/1973 | Kuribayashi | 381/16 |
| 3,908,090 | 9/1975 | Kahn | 381/16 |
| 4,015,222 | 3/1977 | Werner | 332/22 |
| 4,185,171 | 1/1980 | Parker | 381/16 |
| 4,225,751 | 9/1980 | Hershberger | 179/1 |
| 4,236,042 | 11/1980 | Leitch | 179/1 |
| 4,323,731 | 4/1982 | Hershberger | 179/1 |
| 4,324,952 | 4/1982 | Smiley | 179/1 |
| 4,338,491 | 7/1982 | Parker et al. | 381/16 |
| 4,373,115 | 2/1983 | Kahn | 179/1 |
| 4,401,853 | 8/1983 | Fisher et al. | 179/1 |
| 4,458,361 | 7/1984 | Tanabe et al. | 381/15 |
| 4,502,148 | 2/1985 | Ishida et al. | 381/13 |
| 4,510,614 | 4/1985 | Fisher et al. | 381/16 |
| 4,581,748 | 4/1986 | Sasaki et al. | 332/17 |

*Primary Examiner*—Forester W. Isen

*Attorney, Agent, or Firm*—Hill, Van Santen, Steadman & Simpson

[57] ABSTRACT

An apparatus for modulating signals for use in AM stereo transmission having left and right signal inputs feeding respective inverted and non-inverted inphase modulators and respective inverted and non-inverted quadrature modulators. The inverted and non-inverted inphase outputs are summed, the inverted and non-inverted quadrature outputs are summed, and the resulting inphase and quadrature signals are summed. The resulting signal is fed to a limiter and then to a broadcast transmitter, such as a difference transmitter, as a radio frequency input.

12 Claims, 3 Drawing Figures

FIG. 1
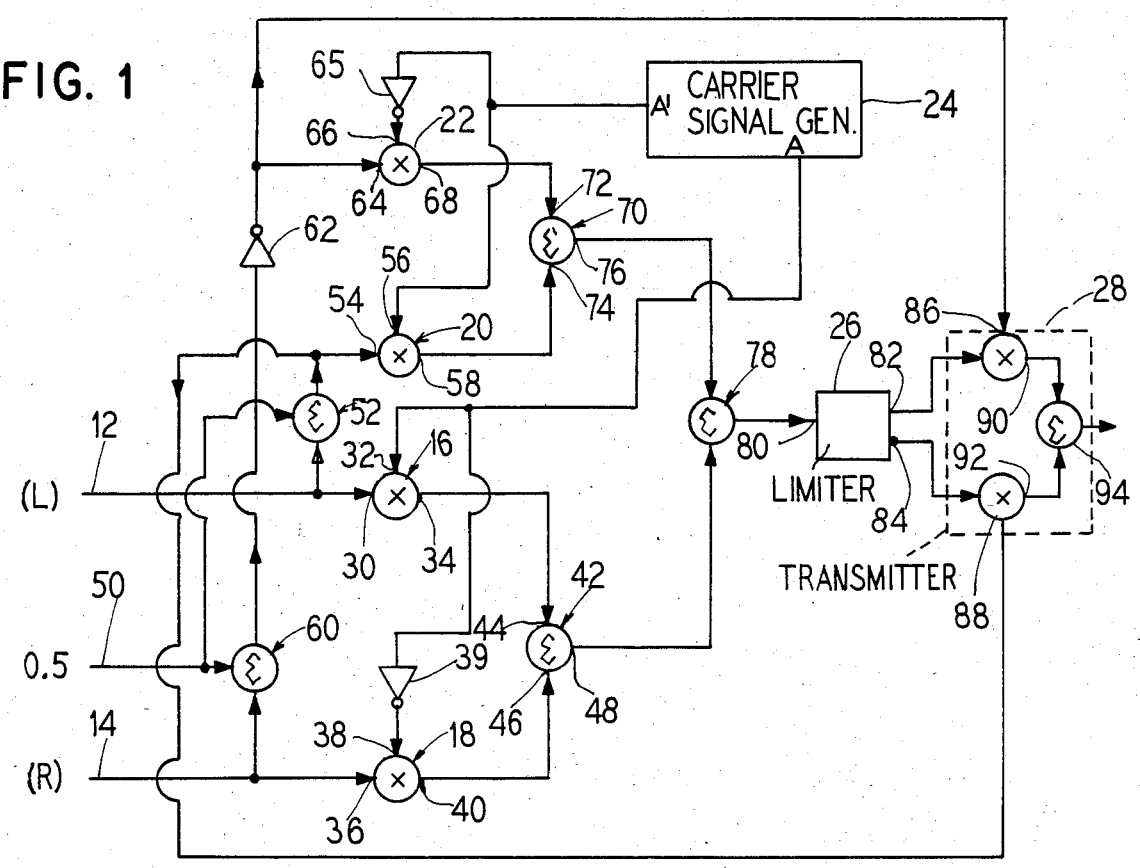
FIG. 2
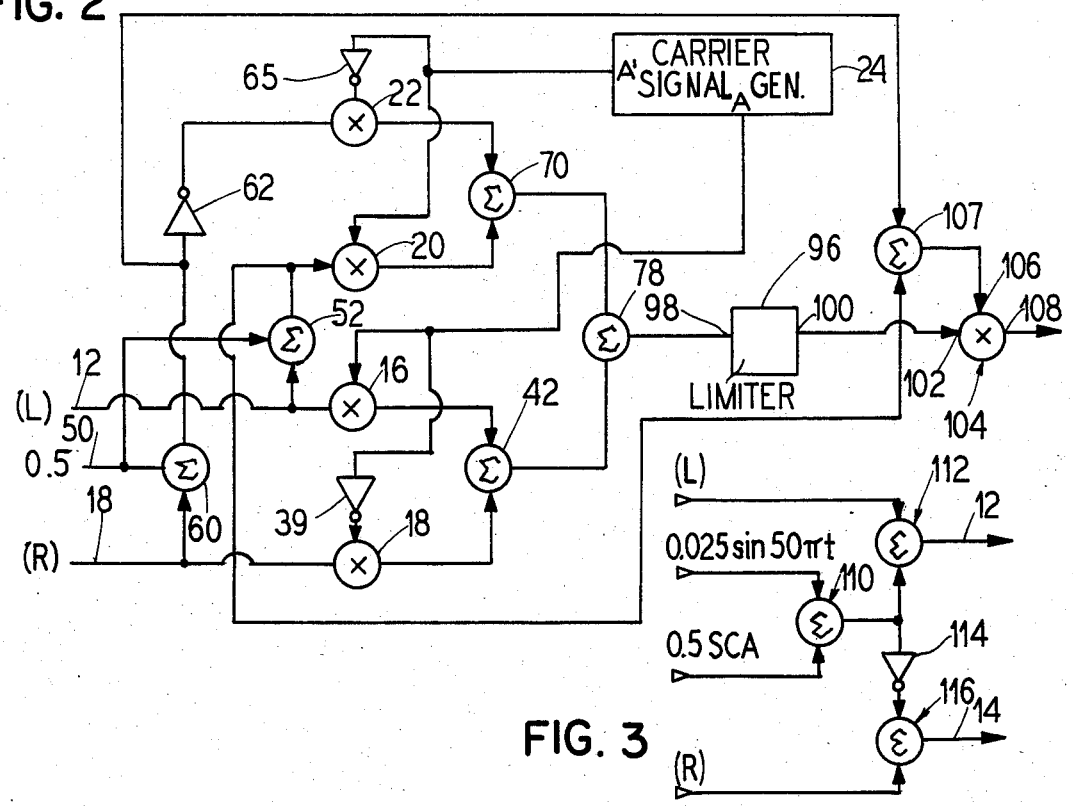
FIG. 3

INDEPENDENT CHANNEL MODULATION SYSTEM FOR AM STEREO

BACKGROUND OF THE INVENTION

1. Field of the Invention

The present invention relates generally to a modulation system and method which is to be incorporated as part of an AM stero radio station, and in particular, to an AM quadrature modulator having independent channel modulation.

2. Description of the Prior Art

Many types of AM stereo modulation systems are known in the art. These include quadrature modulation systems in which a first signal modulates a carrier signal, and a second signal modulates a carrier signal having a 90° phase difference from the first carrier signal. The second, or quadrature, modulator is a suppressed carrier type, such that only the sidebands of the modulated signal remain. The quadrature modulated sidebands are added to the output signal of the first modulator to produce quadrature modulation.

For AM stereo transmission, the input of the first transmitter is the main (L+R) signal and the input of the second transmitter is the stereo (L−R) signal. This "pure quadrature" modulation is not compatible with current AM receivers.

A compatible quadrature modulation system, as described in Motorola Incorporated's "Introduction to Motorola C-Quam AM Stereo System" by Chris Payne, dated 1982, first generates pure quadrature modulation as described above, after which the quadrature signal is fed through a limiter which removes the amplitude information, i.e., inphase sidebands, and leaves only the quadrature phase information in the carrier signal. This quadrature phase shifted carrier is fed into a broadcast transmitter as the radio frequency input and the main (L+R) signal is fed to the broadcast transmitter as the audio input.

Other AM stereo quadrature modulators are disclosed in U.S. Pat. Nos. 4,401,853; 4,373,115; 4,324,952; 4,323,731; 4,236,042; and 4,225,751.

The above quadrature systems perform the summing and difference functions prior to modulation of the sum and difference signals. If the two modulators in those systems are not precisely balanced, cross talk occurs between the two channels. Thus, to adjust for best left-to-right channel separation requires a trade-off in right-to-left channel separation and to adjust for best right-to-left separation requires a trade-off in left-to-right separation.

SUMMARY OF THE INVENTION

It is an object of the present invention to provide non-interacting set-up of left and right channel audio information by providing independent paths for the left and right channels to give improved channel separation.

The above object is inventively achieved in an independent channel modulation system and method for AM stereo wherein left channel signals and right signals are each modulated prior to matrixing or mixing. The present invention provides independent paths for the left and right channels during each modulation step to reduce interaction between the two. The left channel signal is modulated by both inphase and quadrature carrier signals, and similar functions are performed on the right channel signals, after which the sum and difference of the modulated signals are produced. The sum and difference signals, modulated by carriers in quadrature, are summed, producing a phase shift in the resultant signal. A limiter is used then to remove the amplitude components, leaving a phase shifted carrier for use as the radio frequency input for the broadcast transmitter.

The present invention, in a preferred embodiment, further provides independent paths for the left and right channel signals in a differential broadcast transmitter. The left and right channel signals are fed independently to the transmitter to modulate the phase shifted carrier, after which the two modulated carrier signals are added to one another for transmission.

In a second embodiment, a standard broadcast transmitter having a single audio input is used and the main L +R signal modulates the phase shifted carrier.

The present invention thus provides independent paths for left and right stereo signals during modulation so that interaction between the two channels is reduced. In the present system, left-to-right and right-to-left stereo separation are improved without trade-offs in performance.

DESCRIPTION OF THE DRAWINGS

FIG. 1 is a circuit diagram of an independent channel modulation, system for AM stereo constructed in accordance with the principles of the present invention;

FIG. 2 is a circuit diagram of an alternate embodiment of the device shown in FIG. 1; and FIG. 3 is a circuit diagram of a pilot and SCA signal injection circuit for use with the device of FIG. 1.

DESCRIPTION OF THE PREFERRED EMBODIMENTS

An independent channel modulation system 10 for use in AM stereo broadcasting constructed in accordance with the principles of the present invention is shown in FIG. 1. The modulation system 10 includes first and second input terminals 12 and 14; first, second, third, and fourth modulators 16, 18, 20 and 22; a carrier signal generator 24; a limiter 26; and a differential broadcast transmitter 28.

The first input terminal 12, which in the present example receives left channel signals, although it could also be used for right channel signals, is connected to a signal input 30 of the first modulator 16, which is designated the quadrature modulator as will be explained later. The signal from the input 12 modulates a carrier signal A being fed into a carrier input 32 of the modulator 16. The carrier signal A, which, in a preferred embodiment, is a signal of the form $A_c \sin \omega_c t$, is generated by the carrier generator 24. The modulated output signal appears at a modulated output 34 of the quadrature modulator 16.

The second input terminal 14, which in the present example receives right channel signals although it could also be used for left channel signals, is connected to a signal input 36 of the second modulator 18, or inverted quadrature modulator. The signal from the second input terminal 14 modulates a carrier signal −A being fed into a carrier input 38, which is the inverted carrier A. The inverted carrier signal A is produced by feeding the carrier signal A from the carrier signal generator 24 through an inverter 39 producing $-A_c \sin \omega_c t$. The resulting modulated signal is produced at a modulated output 40 of the inverted quadrature modulator 18. The modulated outputs of the modulators 16 and 18 are added by a summing means 42 having a first input 44, a second input 46, and an output 48. It is, thus, subsequent to modulation of the individual channel signals that the left and right signals are first mixed to form the L−R stereo signal.

The signal from the first input terminal 12 is also fed to the third modulator 20, which is designated the inphase modulator. Before the modulator 20, however, a DC signal, such as a 0.5 volt DC signal, from DC input 50 is added to the signal from the input 12 in summing means 52. The left channel signal with a resulting 0.5 volt offset is then fed into a signal input 54 of the inphase modulator 20. The offset left channel signal at signal input 54 modulates a carrier A′ which is fed to the inphase modulator 20 at a carrier input 56. The modulated inphase carrier occurs at modulated output 58.

In similar fashion, the right channel signal from the input 14 is offset by a 0.5 volt DC signal in summing means 60. The offset right channel signal is then passed through an inverter 62 and fed into a signal input 64 of the fourth modulator 22, or inverted inphase modulator. A carrier signal −A′ is produced by inverting the carrier signal A′ in inverter 65 after which it is fed into carrier input 66 of the inverted inphase modulator 22 and a resulting modulated signal is produced at modulated output 68.

The carrier signal A′, which in a preferred embodiment is represented mathematically as $A_c \cos \omega_c t$, leads the carrier $A_c \sin \omega_c t$ by 90° and therefore $A_c \sin \omega_c t$ can be said to be in quadrature to $A_c \cos \omega_c t$. This designation, however, is somewhat arbitrary as the $A_c \cos \omega_c t$ signal may have instead been designated as the quadrature signal, in which case the $A_c \sin \omega_c t$ signal would be the inphase carrier, the term quadrature referring only to a phase difference between the two signals. For purposes of the present invention, it is also foreseen to use phase differences other than 90°. Many types of carrier generators 24 are known for producing the quadrature signals including the use of an oscillator and a Johnson counter.

The modulated inphase signals from the outputs 58 and 68 are fed into a summing means 70 at first and second inputs 72 and 74 thereof. The signal from the inphase summing means 70 at output 76 is added to the signal from the quadrature summing means 42 in summing means 78. This addition operation may be expressed mathematically as:

$$[1 + L + R]\, A_c \cos \omega_c t + [L - R]\, A_c \sin \omega_c t =$$

$$A_c \sqrt{(1 + L + R)^2 + (L - R)^2}\ \cos(\omega_c t + \theta),$$

$$\text{where } \tan \theta = \frac{L - R}{1 + L + R}$$

As can be seen, the addition of these two signals produces a phase shift $$\theta = \tan^{-1}\left[\frac{L - R}{1 + L + R}\right]$$

It may be understood from the foregoing that the left and right channel signals vary as a function of time and therefore that the phase angle $\theta$ also varies with time. The phase shifted signal identified above is then fed into an input 80 of the limiter 26 which strips the signal of its amplitude modulated components leaving only the phase shifted carrier portion $A_c \cos(\omega_c t + \theta)$.

The limiter 26 of the preferred embodiment shown in FIG. 1 includes both non-inverting and inverting outputs 82 and 84, which feed the two signal paths of the differential transmitter 28. In keeping with the concept of independent paths for right and left channel signals, the phase shifted carrier from the non-inverting output 82 is modulated by the offset right channel signal from the inverter 62 in a fifth modulator 86. The phase shifted carrier from the inverting output 84 is modulated in a sixth modulator 88 by the offset left channel signal. An output 90 of modulator 86 and an output 92 of the modulator 88 are then joined at a summing means 94 to produce the signal for broadcast. The operation of the differential transmitter is represented mathematically as:

$$(-0.5-R)[-A_c \cos(\omega_c t+\theta)]+(0.5+L)[A_c \cos(\omega_c t+\theta)]=(1+L+R)A_c \cos(\omega_c t+\theta).$$

Thus it can be seen that the channel signal information is modulated independently by quadrature modulators 16 and 18 and by inphase modulators 20 and 22 prior to matrixing the channel signals. Furthermore, the broadcast transmitter 28 modulates the left and right channel signals independently prior to matrixing the signals for broadcast. This preserves the independent nature of the right and left channel signals and provides improved channel separation without sacrificing system performance.

In a second embodiment, the left and right channel signals are modulated independently by inphase and quadrature carriers, just as in the first embodiment. However, as shown in FIG. 2, the second embodiment utilizes a single output limiter 96 which receives the output signal from the summing means 78 at input 98 and produces the phase modulated carrier at an output 100. The phase shifted carrier from the limiter output 100 is fed into a radio frequency input 102 of a standard AM broadcast transmitter 104 having a single audio input 106. The left and right channel signals are added in summing means 107 to produce the main, or monaural, signal for the audio input 106 of the transmitter 104. The modulated output of the broadcast transmitter 102 on output 108 is then transmitted in the normal fashion.

The modified independent channel modulator of the second embodiment has many of the channel separation advantages of the fully independent modulator of the preferred embodiment, while enabling a standard broadcast transmitter to be used, thus avoiding cost of purchasing new equipment.

The 0.5 volt DC offset which is added to each channel prior to inphase modulation provides, after summing of the modulated signals, a 1 volt reference so that a carrier signal is still broadcast even if no signal is present in either the left or right channels. Many other means for providing for broadcast of a carrier in the event of no left and right channel signals are contemplated, including, for example, providing a DC offset to one of the channel signals prior to modulation or directly injecting a carrier after summing of the modulated signals.

FIG. 3 shows a circuit for injecting pilot and subsidary communication authorization (SCA) signals into the left and right channels independently prior to the first and second input terminals 12 and 14 of the above-described independent channel modulation system 10.

A 25 Hz pilot signal, shown as 0.025 sin $50\pi t$, is added in summing means 110 to one-half of the required SCA signal and the result is added to the left channel signal in summing means 112, the output of which is fed to the left channel input 12. The pilot tone and SCA are fed through an inverter 114 and added to the right channel signal in summing means 116 prior to being fed into the right channel input 14 of the above-described device 10. A pilot tone of 5 % injection and an SCA signal of desired strength are thus present after summing the modulated signals.

Although modifications and changes may be suggested by those skilled in the art, it is the intention of the inventor to embody within the patent warranted hereon all changes and modifications as reasonably and properly come within the scope of his contribution to the art.

I claim as my invention:

1. An independent channel modulation system for generating a signal to be transmitted for use with a generator for generating first, second, third and fourth carrier signals comprising:

first and second input terminals;

a first modulator connected to said first input and to said means for generating said first carrier signal for modulating said first carrier signal with a signal from said first input;

a second modulator connected to said second input and to said means for generating said second carrier signal for modulating said second carrier signal by a signal from said second input;

a third modulator connected to said first input and to said means for generating said third carrier signal for modulating said third carrier signal by a signal from said first input;

a fourth modulator connected to said second input and to said means for generating said fourth carrier signal for modulating said fourth carrier signal by a signal from said second input;

first summing means connected for summing the outputs of said first and second modulators;

second summing means connected for summing the outputs of said third and fourth modulators; and third summing means connected for summing the outputs of said first and second summing means, said third summing means having an output for said signal to be transmitted.

2. A system as claimed in claim 1 wherein said means for generating said second carrier is an inverter connected to said means for generating said first carrier, wherein said means for generating said fourth carrier is an inverter connected to said means for generating said third carrier and wherein said means for generating said third carrier is a means connected to said means for generating said first carrier for phase shifting said first carrier.

3. A system as claimed in claim 1 further comprising:

a limiter having an input connected to said output of said third summing means and having inverting and non-inverting outputs;

a fifth modulator having a radio frequency input connected to said inverting output of said limiter and a signal input connected to said first input terminal;

a sixth modulator having a radio frequency input connected to said non-inverting output of said limiter and a signal input connected to said second input terminal; and fourth summing means connected for summing the output of said fifth modulator and the output of said sixth modulator.

4. An independent channel modulation system comprising:

first and second input terminals for stereo signals;

a carrier signal generator for generating respective inphase and quadrature carrier signals;

inverter means for generating respective inverses of said inphase and quadrature carrier signals;

a first modulator connected for modulating an inphase carrier signal received from said carrier signal generator by a signal from said first input terminal;

a second modulator connected for modulating an inverse inphase carrier signal received from said inverter means by a signal from said second input terminal;

first summing means connected for summing the output signals from said first and second modulators;

means for offsetting the signals from said first and second input terminals;

a third modulator connected for modulating a quadrature carrier signal received from said carrier signal generator by an offset signal from said first input terminal;

a fourth modulator connected for modulating an inverse quadrature carrier signal received from said inverse means generator by an offset signal from said second input terminal;

second summing means connected for summing the outputs of said third and fourth modulators;

third summing means connected for summing the outputs of said first and second summing means;

a limiter connected to the output of said third summing means; and a transmitter having a radio frequency input connected to the output of said limiter for transmitting modulated signals from said limiter.

5. An AM stereo modulating system for use with a limiter, a carrier signal generator, and a broadcast transmitter comprising:

first and second input terminals for stereo signals;

a first modulator connected to said first input terminal and having a carrier input connected to said carrier signal generator;

a second modulator connected to said second input terminal and having an inverted carrier input connected to said carrier signal generator, an output of said first modulator connected to an output of said second modulator;

means for offsetting signals from said first and second input terminals;

a third modulator connected to receive the offset signal from said first input terminal and having a quadrature carrier input for receiving phase shifted carrier signals from said carrier signal generator;

an inverter connected to invert the offset signal from said second input terminal;

a fourth modulator connected to receive the inverted signal from said inverter and having an inverse quadrature carrier input connected to receive phase shifted carrier signals from said carrier generator, an output of said fourth modulator connected to an output of said third modulator; and means for summing said connected outputs of said first and second modulators with said connected outputs of said third and fourth modulators having an output for feeding the resulting signal through the limiter to the broadcast transmitter.

6. An AM stereo modulator system for use with a carrier signal generator and a broadcast transmitter having a radio frequency input and an audio input, comprising:

first and second channel inputs for receiving first and second channel signals;

a first amplitude modulator having a carrier input connected to receive a first carrier signal from the carrier signal generator and a signal input connected to receive channel signals from said first channel input;

a second amplitude modulator having a carrier input connected to receive an inverted first carrier signal from the carrier signal generator and a signal input connected to receive channel signals from said second channel input, a modulated output of said first amplitude modulator connected to a modulated output of said second amplitude modulator;

a third amplitude modulator having a carrier input connected to receive a second carrier signal in quadrature to the first carrier signal from the carrier signal generator and a signal input connected to receive channel signals from the first channel input;

a fourth amplitude modulator having a carrier input connected to receive an inverted second carrier signal from the carrier signal generator and a signal input connected to receive channel signals from said second channel input, a modulated output of said third amplitude modulator connected to a modulated output of said fourth amplitude modulator;

means for summing signals connected to sum the signals from said connection of said first and second amplitude modulators and said connection of said third and fourth amplitude modulators;

a limiter connected to receive signals from said summing means and having an output connected to the radio frequency input of the broadcast transmitter.

7. A system as claimed in claim 6 further comprising means for feeding a carrier signal to said limiter.

8. A system as claimed in claim 7 wherein said carrier feeding means comprises means for adding a DC signal to the first and second channel signals prior to said third and fourth amplitude modulators.

9. A system as claimed in claim 6 further comprising means for inverting the second channel signal prior to said fourth amplitude modulator.

10. A system as claimed in claim 6 further comprising means for feeding the first and second channel signals to the audio input of the broadcast transmitter.

11. A method of modulating a stereo signal for AM stereo transmission comprising:

modulating a first carrier signal by a first channel signal;

modulating a second carrier signal by a second channel signal wherein said second carrier is said first carrier inverted;

adding an offsetting signal to said first and second channel signals;

modulating a third carrier signal by said offset first channel signal wherein said third carrier is in quadrature to said first carrier;

inverting said offset second channel signal;

modulating a fourth carrier signal by said inverted offset second channel signal wherein said fourth carrier is said third carrier inverted;

adding said modulated first and second carrier signals to one another;

adding said modulated third and fourth carrier signals to one another;

adding the sum of said first and second modulated carrier signals to the sum of said third and fourth modulated carrier signals;

limiting the sum of said first, second, third and fourth modulated carrier signals;

modulating said limited signals by said first and second channel signals; and transmitting said modulated limited signal.

12. A method as claimed in claim 11 further comprising the steps of:

modulating said limited signal by said first channel signal;

inverting said limited signal;

modulating said inverted limited signal by said second channel signal; and adding said modulated inverted limited signal to said modulated limited signal.

* * * * *